US010407139B2

(12) United States Patent
Thomason

(10) Patent No.: US 10,407,139 B2
(45) Date of Patent: Sep. 10, 2019

(54) SYSTEM AND METHOD FOR SUPPORTING A PAIR OF SEATS

(71) Applicant: John Thomason, Anguilla, MS (US)

(72) Inventor: John Thomason, Anguilla, MS (US)

(73) Assignee: Dub-L-Seat, LLC, Belmont, MS (US)

( * ) Notice: Subject to any disclaimer, the term of this patent is extended or adjusted under 35 U.S.C. 154(b) by 17 days.

(21) Appl. No.: 15/488,463

(22) Filed: Apr. 15, 2017

(65) Prior Publication Data

US 2017/0305508 A1 Oct. 26, 2017

Related U.S. Application Data

(60) Provisional application No. 62/324,991, filed on Apr. 20, 2016.

(51) Int. Cl.

| | |
|---|---|
| ***B63B 29/06*** | (2006.01) |
| ***B63B 29/04*** | (2006.01) |
| *A47C 15/00* | (2006.01) |
| *A47C 7/00* | (2006.01) |

(52) U.S. Cl.

CPC ..... *B63B 29/06* (2013.01); *B63B 29/04* (2013.01); *A47C 7/004* (2013.01); *A47C 15/004* (2013.01); *B63B 2029/043* (2013.01)

(58) Field of Classification Search

CPC .. A47C 1/08; A47C 1/06; A47C 9/022; A47C 13/005; A47C 11/005; A47C 3/18; A47C 7/004; B63B 29/04; B63B 29/06; B63B 2029/043; A47B 17/065; A47B 83/02

USPC ..... 297/241, 242, 272, 344.24, 240, 344.18, 297/173, 232; 108/103, 158.11

See application file for complete search history.

(56) References Cited

U.S. PATENT DOCUMENTS

| | | | | | |
|---|---|---|---|---|---|
| 1,322,551 | A * | 11/1919 | Efaw | A47C 1/08 | 297/241 |
| 1,552,104 | A * | 9/1925 | Zahner | A47B 83/02 | 108/99 |
| 1,686,464 | A * | 10/1928 | Lyman | A47C 1/08 | 297/241 |
| 2,212,777 | A * | 8/1940 | Goodman | A47C 1/08 | 297/241 |
| 2,446,376 | A * | 8/1948 | Littlejohn | A47C 1/08 | 297/241 |
| 2,554,852 | A * | 5/1951 | Bryan | A47C 1/08 | 123/73 S |
| 2,557,232 | A * | 6/1951 | Morgan | A47C 1/08 | 297/241 |
| 2,562,372 | A * | 7/1951 | Einar | B63B 7/06 | 114/356 |
| 3,016,223 | A * | 1/1962 | Hoag | A47C 1/08 | 248/188.1 |
| 3,164,351 | A * | 1/1965 | Rembowski | A47B 9/14 | 248/188.5 |
| 3,855,946 | A * | 12/1974 | Bales | A47B 9/14 | 108/147.21 |

(Continued)

*Primary Examiner* — Jonathan Liu
*Assistant Examiner* — Taylor L Morris
(74) *Attorney, Agent, or Firm* — David E Herron, II

(57) ABSTRACT

The disclosure depicts a system and method for supporting a pair of seats. The system includes a center post, first and second arms engaging the center post at the initial end of each, and engaging a respective support pillar adjacent a terminal end of each. A respective seat is mounted atop each respective support pillar.

12 Claims, 5 Drawing Sheets

(56) References Cited

U.S. PATENT DOCUMENTS 4,400,032 A * 8/1983 dePolo ..... A47C 3/18 248/416
4,542,936 A * 9/1985 Gafken ..... A47C 7/024 108/105
4,590,866 A * 5/1986 Schairbaum ..... A47B 17/02 108/23
4,597,356 A * 7/1986 McCaghren ..... B63B 29/04 114/153
4,645,167 A * 2/1987 Hardwick ..... B63B 29/04 248/283.1
4,662,679 A * 5/1987 Franck ..... A47C 11/005 297/240
4,709,649 A 12/1987 Wann
4,766,838 A * 8/1988 Johnson ..... B63B 29/04 114/363
4,979,458 A 12/1990 Bouza
5,346,415 A * 9/1994 Waymon ..... B63B 29/06 114/363
5,494,333 A * 2/1996 Wilson ..... A47C 7/002 248/188.5
5,529,374 A * 6/1996 Wimberly, Jr. ..... A47C 1/08 297/195.12
5,943,966 A * 8/1999 Machado ..... A47B 87/002 108/64
5,957,419 A 9/1999 Lancaster et al.
5,957,529 A * 9/1999 Schrewe ..... A47C 13/005 297/173
5,992,804 A * 11/1999 Johnson ..... B63B 29/06 114/363
6,012,775 A * 1/2000 Czarnecki ..... A47C 3/30 297/344.13
6,106,060 A * 8/2000 Staehlin ..... A47C 1/121 297/234
6,161,487 A * 12/2000 Chang ..... A47B 17/065 108/50.01
6,247,772 B1 * 6/2001 Tuttle ..... A47B 17/065 108/146
6,347,777 B1 * 2/2002 Webber ..... A47C 7/402 248/188.5
6,478,267 B1 * 11/2002 Whitman ..... B60N 2/3097 248/157
6,497,184 B1 * 12/2002 Whitesitt ..... A47B 17/065 108/64
6,662,734 B2 * 12/2003 Chang ..... A47B 17/065 108/103
6,692,076 B1 * 2/2004 Burer ..... A47C 7/56 297/331
6,739,280 B2 5/2004 Keller
6,895,709 B1 * 5/2005 Krien ..... A47B 83/02 42/94
6,920,834 B1 * 7/2005 Pehta ..... A47B 9/14 108/147.21
7,533,931 B1 * 5/2009 Bryant, Sr. ..... A47C 7/62 297/188.08
7,647,880 B2 * 1/2010 Devine ..... B63B 29/04 114/363
8,297,699 B1 * 10/2012 Midkiff ..... A01K 97/22 297/143
8,336,835 B1 * 12/2012 Benner ..... E04F 21/1805 248/188.5
8,485,488 B2 * 7/2013 Forrest ..... A47B 91/02 248/188.8
10,023,272 B1 * 7/2018 O'Neal, Jr. ..... B63B 29/06
2003/0097972 A1 5/2003 Keller
2005/0034783 A1 * 2/2005 Laird ..... B25H 1/04 144/286.5
2007/0216205 A1 * 9/2007 Davis ..... A47C 1/08 297/241
2011/0227382 A1 * 9/2011 Hay ..... A47C 9/022 297/242
2011/0247530 A1 * 10/2011 Coffman ..... A47B 3/0911 108/116
2013/0129405 A1 * 5/2013 Everett ..... A47B 13/088 403/66
2018/0110335 A1 * 4/2018 O'Hagan ..... A01K 97/22
2018/0125233 A1 * 5/2018 Leier ..... A47B 13/023

* cited by examiner

SYSTEM AND METHOD FOR SUPPORTING A PAIR OF SEATS

FIELD AND BACKGROUND OF INVENTION

The invention is a system and method for supporting a pair of seats. While a best mode for using the invention incorporates a system including a boat, the invention is well-suited for use in other applications and environments as well. For example, many fishing boats are equipped with brackets and mounts for a single chair, which precludes one from fishing alongside another person. The invention herein disclosed allows to persons to sit adjacent one another.

SUMMARY OF THE INVENTION

The invention is an inventive system and an inventive method, each for supporting a pair of seats.

The Inventive System

The inventive system requires a center post, and a first arm that rotatably engages the center post adjacent its initial end. The system also requires a second arm rotatably engaging the center post adjacent from its initial end.

Moreover, the system includes a primary support pillar with a ground engaging end and a seat-engaging end. The primary support pillar engages the first arm adjacent a terminal end of the first arm. Analogously, the system also comprises a secondary support pillar with a ground engaging end and a seat engaging end. The secondary support pillar engages the second arm adjacent a terminal end of the second arm.

A preferred embodiment of the inventive system includes a first collar positioned adjacent a terminal end of the first arm. In this embodiment, the primary support pillar slidably engages within the first collar. The system may also include a central collar positioned adjacent an initial end of the first arm. The center post may engage within the central collar. In a preferred embodiment of the inventive system, the center post engages a deck surface of a boat.

The system may also have a second collar positioned adjacent a terminal end of the second arm. In this embodiment of the system, the secondary support pillar slidably engages within the second collar. The system may also include a respective seat mounted on each of the respective support pillars. In order to enable selective adjustment of the length of each respective arm, the first arm and second arm may each respectively comprise telescoping tubes. As such, the seats may be selectively positioned by altering the length of the arms and the angle formed therebetween.

In order to increase stability of each respective support pillar, one may position a base adjacent the ground engaging end of each. The base may comprise at least one of a roller or a cushion for reducing friction.

The Inventive Method

The inventive method requires the steps of providing a center post and extending a first arm outwardly from the center post. The first arm engages the center post from its initial end, and it engages a first support pillar adjacent its terminal end. The method also requires the step of extending a second arm outwardly from the center post. The second arm engages the center post from its initial end, and engages a secondary support pillar adjacent its terminal end.

The inventive method also includes the steps of forming the primary support pillar to engage through a first collar adjacent the terminal end of the first arm. To wit, this first collar circumscribes the primary support pillar at a location between a ground engaging end and a seat engaging end. In like manner, the inventive method also requires the step of forming the secondary support pillar to engage through a second collar adjacent the terminal end of the second arm. The second collar circumscribes the secondary support pillar at a location between a ground engaging end and a seat engaging end.

In a preferred embodiment, the primary support pillar slidably engages within the first collar. Further, the inventive method may also include the step of positioning a central collar adjacent an initial end of the first arm and engaging the center post within the central collar.

In another preferred embodiment, one positions a middle collar adjacent an initial end of the second arm; wherein, the center post engages within the middle collar. The first and second arms may comprise telescoping tubes. Moreover, the center post may engage a deck surface of a boat. Preferably, the center post engages within a pre-formed vessel formed to is receive the base of a seat manufactured to mount upon the deck of the boat.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
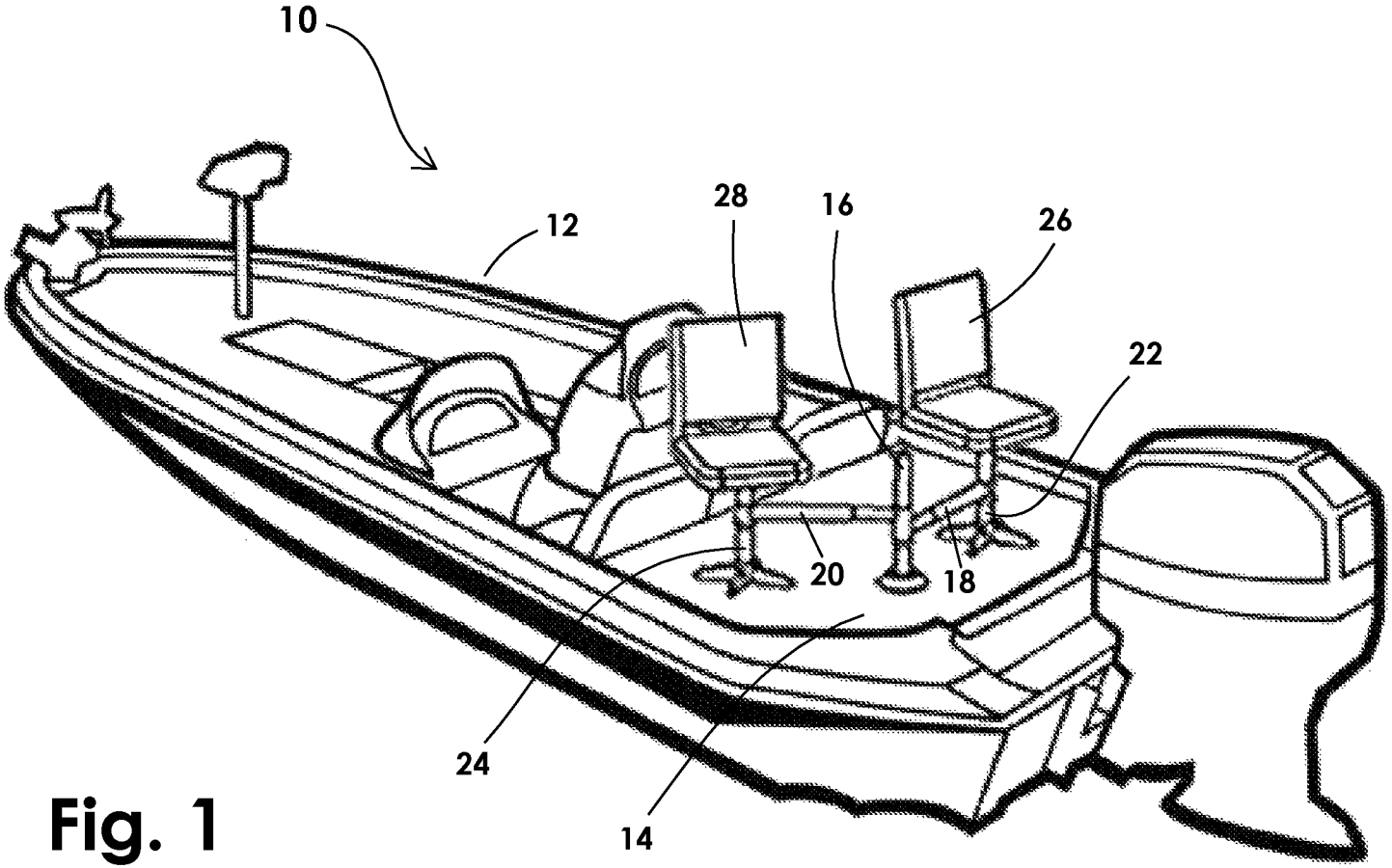
FIG. 1 shows a perspective view of the inventive system in combination with a boat, according to the principles of the invention FIG. 2 provides an exploded view detailing the components of the inventive system.

FIG. 1 shows a perspective view of the inventive system 10 in combination with a fishing boat 12. The system 10 includes a center post 16 mounted on a deck 14 adjacent the stern of the boat 12, but of course the system is well-suited to be positioned on any horizontal surface on the boat 12. For example, the apparatus may be well-suited for positioning adjacent the bow end of the boat 12 as well.

Still referring to FIG. 1, the system 10 also includes a first arm 18 extending outwardly from the center post 16. The first arm 18 engages the center post 16 at its initial end, and engages a primary support pillar 22 adjacent its terminus. A first seat 26 is mounted to a seat-engaging end of the primary support pillar 22, while the bottom of the primary support pillar engages 22 the deck 14 of the boat 12.

As shown in FIG. 1, the system 10 also includes a second arm 20 connecting the center post 16 with a secondary support pillar 24. A second seat 28 mounts atop the secondary support pillar 24, which engages the deck of the boat 14 at its lower end.

Figure 2:
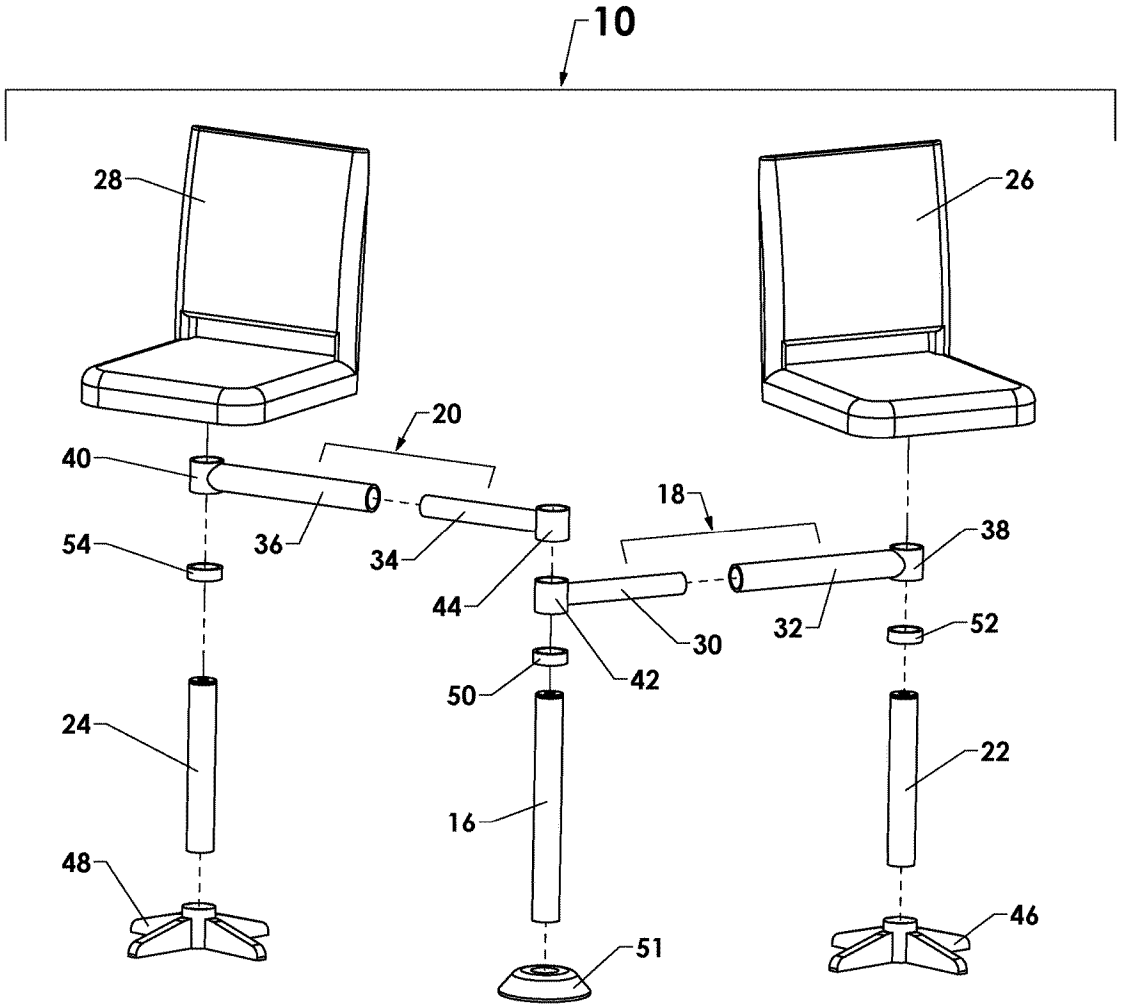

FIG. 2 provides an exploded view of the inventive system. The system 10 will include a center post 16, having a stop 50 upwardly displaced from its base 51. The first arm 18 (as in FIG. 1) comprises a pair of telescoping tubes. Specifically, the first arm 18 (as in FIG. 1) includes an inner tube 30 inserted into outer tube 32. The inner tube 30 of first arm 18 (see FIG. 1) includes a central collar 42 encompassing the center post 16. Preferably, the width of the central collar 42 and the diameter of the center post 16 should be cooperatively selected to enable rotation and translation of the central collar 42 relative the center post 16.

Still referring to FIG. 2, the outer tube 3032 of the first arm 18 (see FIG. 1) bears a first collar 38 formed to engage the primary support pillar 22. Preferably, the width of the first collar 38 and the circumference of the primary support pillar 22 are cooperatively chosen to enable rotation and translation of the first collar 38 relative the primary support pillar 22.

As shown in FIG. 2, the primary support pillar 22 has a stop 52 positioned above its base 46. The stop 52 is positioned to engage the first collar 38 when the system 10 is assembled.

FIG. 2 further shows that the second arm 20 (as in FIG. 1) comprises an inner tube 34 formed to fit within an outer tube 36. A middle collar 44 formed at the initial end of the inner tube 34 engages around center post 16. Moreover, a second collar 40 is formed adjacent the terminal end of the outer tube 36. The second collar 40 bears a diameter slightly greater than the diameter of the secondary support pillar 24, which enables the second collar 40 to engage around the secondary support pillar 24 to enable relative rotation and translation of the secondary support pillar 24 within the second collar 40.

Still referring to FIG. 2, a second seat 28 is mounted adjacent the top of the secondary support pillar 24 while a base 48 is positioned adjacent the bottom in order to provide stability. The secondary support pillar 24 also bears a stop 54 formed to engage the second collar 40.

In a preferred embodiment of the system 10 shown in FIG. 2, each respective seat 26, 28 will be mounted atop its respective support pillar 22, 24 in such a manner that will enable rotation of the respective seat about its respective support pillar.

Figure 3:
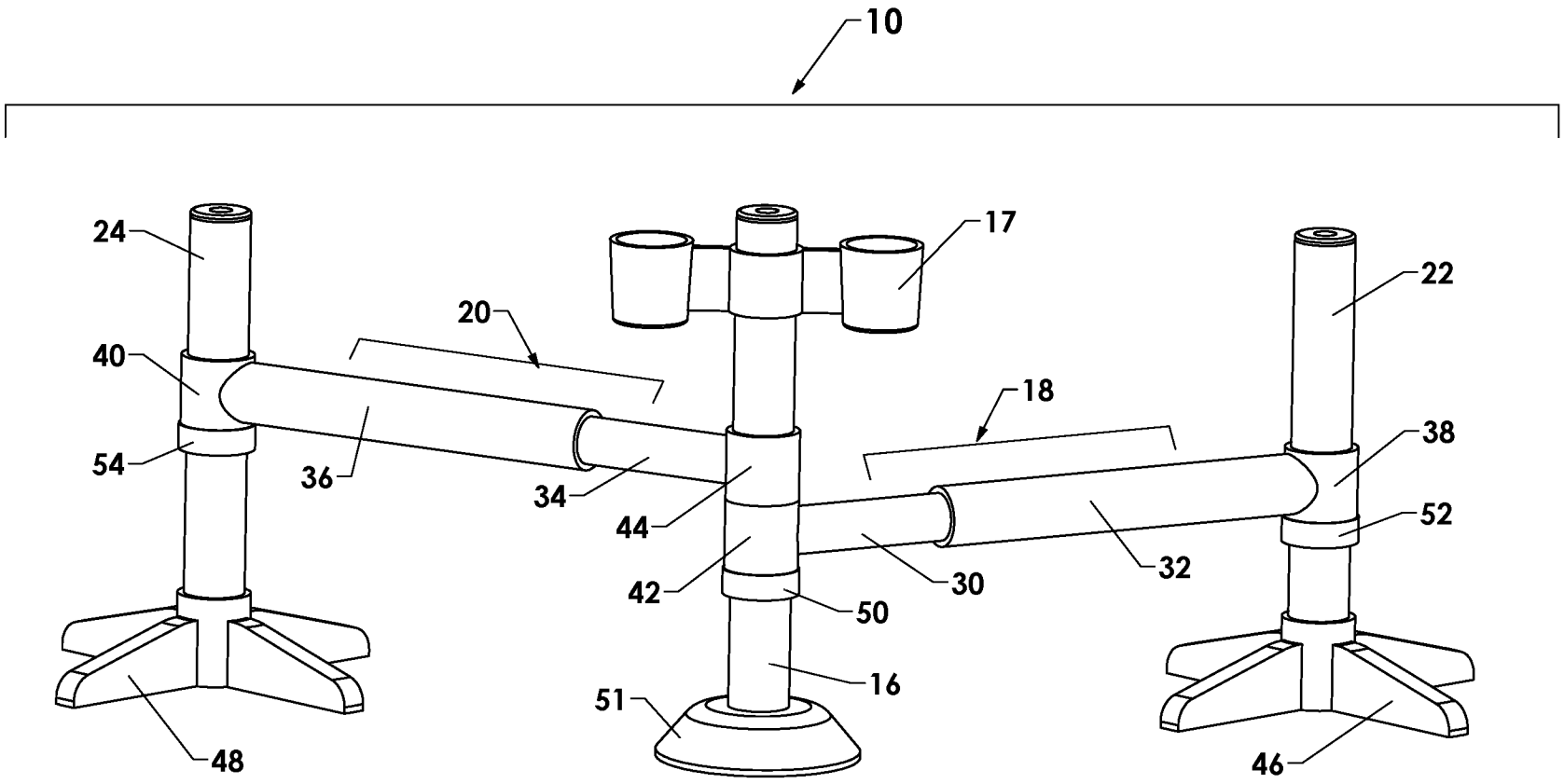
FIG. 3 shows a perspective view of the component parts of the inventive system, shown in a partially assembled condition.

FIG. 3 shows a perspective and isolated view of the components of the inventive system 10, shown in an assembled condition. For the sole purpose of clarity, the seats are not shown in FIG. 3. A center post 16 extends upward from its base 51, and a first arm 18 and a second arm 20 each extend from the center post 16. The first arm 18 includes a central collar 42, an inner tube 30, and an outer tube 32, which terminates in a first collar 38. The central collar 42 engages around the center post 16 and enables rotation of the first arm 18 relative the center post 16. The center post 16 bears a stop 50 formed to engage the surface of the central collar 42.

Still referring to FIG. 3, the second arm 20 includes a middle collar 44 and an inner tube 34 extending into an outer tube 36, which terminates in a second collar 40. As shown, the middle collar 44 engages the center post 16 above the central collar 42; the middle collar 44 is rotatable relative the center post 16. Optionally, an additional stop or spacer may be positioned on the center post 16 between the central collar 42 of the first arm 18 and the middle collar 44 of the second arm 20. Thus, one may selectively position the seats 26, 28 by positioning the first arm 18 at a predetermined angle relative the second arm 20 by respectively rotating each of the central collar 42 and the middle collar 44 about the center post 16.

As shown in FIG. 3, the primary support pillar 22 bears a ground-engaging base 46 at one end, and the first seat (infra) is mounted atop the primary support pillar 22. Analogously, the secondary support pillar 24 bears a ground-engaging base 48 at one end, and the second seat (infra) couples atop the secondary support pillar 24.

Still referring to FIG. 3, an accessory mount 17 may be positioned adjacent a terminal end of the center post 16. The accessory mount may comprise cup holders, vessels to store fishing tackle, for example. In a preferred embodiment, the accessory mount 17 may be configured to support an umbrella that can shade those seated. In yet another embodiment, a seat may be mounted atop the center post 16.

As discussed infra, the first arm comprises telescoping tubes 30, 32. Thus, the length of the first arm 18 may be selectively adjusted by extending the outer tube away from the center post 16, thereby increasing the distance between the first seat 26 and the center post 16. In like manner, the second arm 20 comprises telescoping tubes 34,36. The length of the second arm 20 (FIG. 1) may be adjusted by selectively positioning the outer tube 36 along the inner tube 34.

Figure 3A:
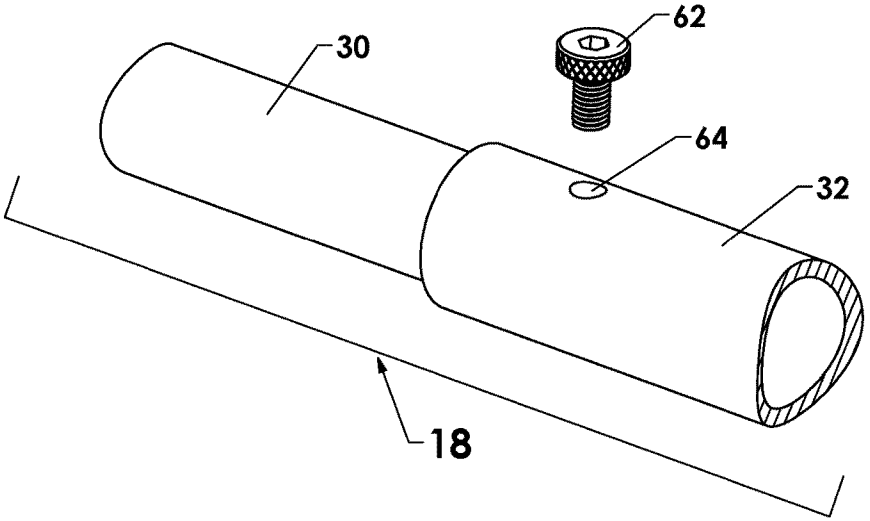
FIGS. 3*a* and 3*b* provide comparative perspective views, isolated upon the lock mechanism.
Figure 3B:
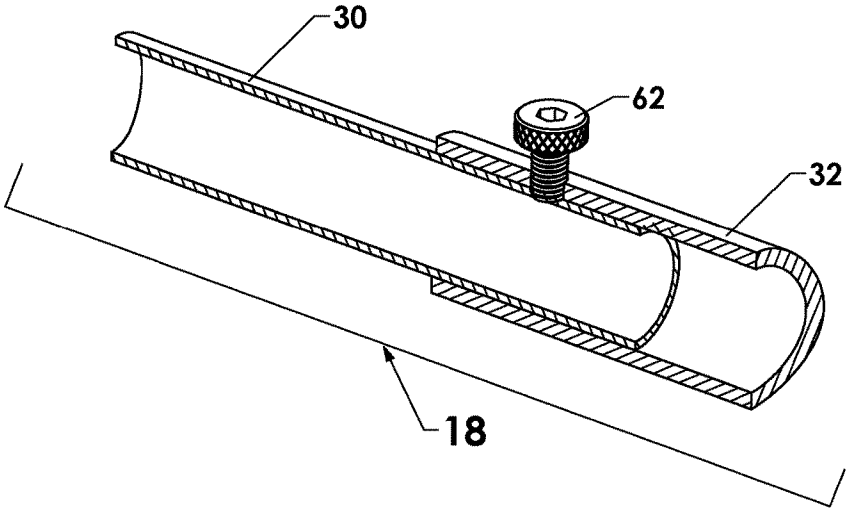

FIGS. 3A and 3B show an isolated view of a lock mechanism that may be positioned on the first arm 18. The inner tube 30 slides within the outer tube 32 to form a first-arm 18 of adjustable length. The outer tube 32 may bear a threaded hole 64 formed to receive a set screw 62. When one achieves the desired length for the first arm 18, the set screw 62 is inserted within the threaded hole 64 until it engages the outer surface of the inner tube 30, thereby locking the tubes 30, 32 to restrict unwanted movement.

The lock mechanism shown in FIGS. 3A and 3B, of course, may also be used to secure the outer tube 36 to the inner tube 34 of the second arm 20. Additionally, in order to increase stability of the system 10, one may form threaded apertures in each collar 38, 40, 42, 44 in order to restrict relative movement of the respective rod passing therethrough. While FIGS. 3A and 3B show a single embodiment of a locking means, other means are also well-suited, such as a peg-and-hole method, or a keyed/ribbed interior, or a spring-loaded lock for example.

Figure 4:
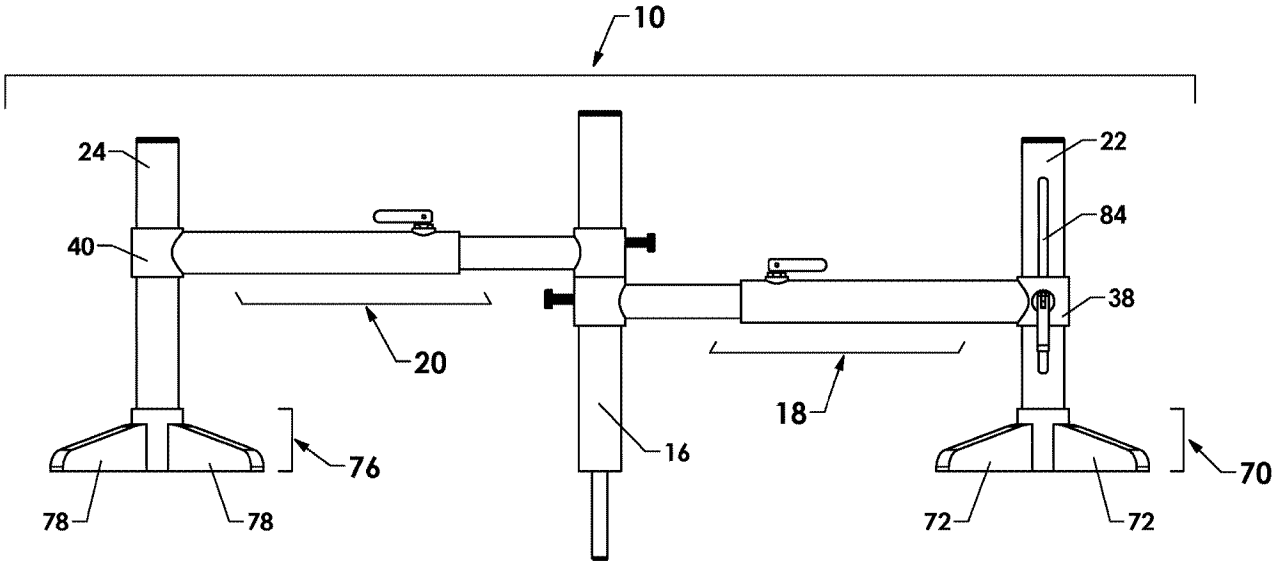
FIG. 4 is a perspective view detailing, an alternate embodiment of the inventive system.

FIG. 4 shows an alternate embodiment of the inventive system 10. In this embodiment, the system 10 also includes a first arm 18 extending outwardly from the center post 16. The first arm 18 engages the center post 16 at its initial end, and engages a primary support pillar 22 adjacent its terminus. The system 10 also includes a second arm 20 connecting the center post 16 with a secondary support pillar 24. First and second seats (not shown in FIG. 4) mount atop the respective support pillars 22, 24. Each support pillar has a base that engages the deck of the boat at its lower end.

Still referring to FIG. 4, the primary support pillar 22 has a base 70 positioned adjacent a deck-engaging end. The base 70 comprises a plurality of braces extending 72 that extend outwardly from the bottom of the primary support pillar 22. The primary support pillar 22 bears a channel 84 formed through a surface of the support pillar 22. The channel 84 is formed to receive an adjustment pin (shown in greater detail in FIG. 5) of a securing means that holds the collar 38 of the first arm 18 to the primary support pillar 22. Comparatively, the secondary support pillar 24 also bears a base 76 comprising a plurality of braces 78 extending outwardly from the bottom of the secondary support pillar 24. Additionally, the second arm 20 extends from the center post 16 to the secondary support pillar 24; a collar 40 is positioned adjacent a terminal end of the second arm 20, and is configured to engage around the secondary support pillar 24. As with the primary support pillar 22, the secondary support pillar also bears a channel for receipt of the pin of a securing mechanism. For simplicity, however, the channel is not shown in this figure but has the same configuration and function as the channel 84 formed on the primary support pillar 22.

Figure 5:
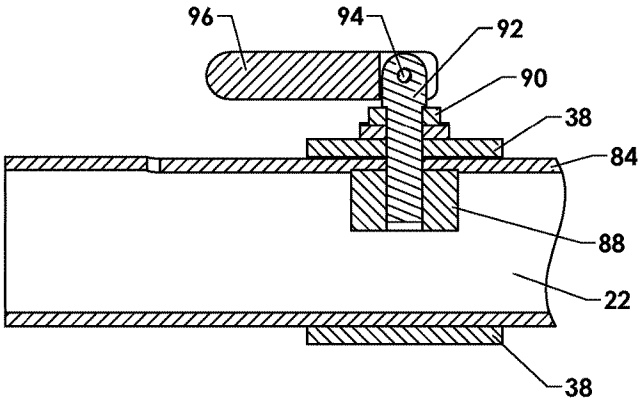
FIG. 5 is a cross-sectional view detailing the aspects of a securing mechanism of the inventive system.

FIG. 5 shows a cross-sectional view of the mechanism employed to secure the primary support pillar 22 to the collar 38 of the first arm 18 (not shown in FIG. 5, viewable in FIG. 4). A pedestal nut 88 is positioned within the primary support pillar 22, and an outer bushing 90 abuts the exterior of the primary support pillar 22. A swivel lock stud 92 passes through the outer bushing 90, through the channel 84 the channel 84 formed on the primary support pillar 22, and engages the nut pedestal within the primary support pillar 22. A swivel lock pin 90 enables selective rotation of a swivel lock handle 96 that can secure the primary support pillar 22 to the collar 38 of the first arm 18. The swivel lock pin 90 is selectively rotatable between a secured position (as shown) and an unsecured position (aligned with lock pin, not shown). When in an unsecured position, the collar 38 may be selectively moved to a desired position along the channel 84, thereby adjusting the height at which the first arm 18 engages the primary support pillar 22.

Comparing the embodiments shown in FIGS. 2 and 3 to FIGS. 4 and 5, one can readily observe that the first arms 18 and second arms 20 each comprise telescoping inner tubes and outer tubes. In preferred embodiments depicted in FIGS. 2 and 3, the inner tubes are adjacent the center post, and outer tubes distal the center post. In the embodiments depicted in FIGS. 4 and 5, however, the outer tubes are adjacent the center post and the inner tubes distal the center post.

Having described and illustrated the invention in detail, it is to be understood that the above and foregoing is for illustration and demonstration only. The descriptions herein are not intended to limit the breadth of this invention, and the scope of the invention shall be defined and limited exclusively by claims.

The invention claimed is:

1. A system for supporting a pair of seats upon a deck of a boat, the system comprising:

a center post secured to the deck;

a first arm rotatably engaging the center post adjacent an initial end of the first arm, the first arm comprising telescoping tubes enabling selective adjustment of a distance separating the initial end of the first arm from a terminal end of the first arm;

a first lock post; wherein each of the telescoping tubes of the first arm comprises at least one hole; and wherein the first lock post is selectively positionable between an unlocked position wherein relative movement between the telescoping tubes is enabled;

and a locked position wherein the lock post restricts relative movement of the telescoping tubes of the first arm;

a second arm rotatably engaging the center post adjacent an initial end of the second arm, the second arm comprising telescoping tubes enabling selective adjustment of a distance Separating the initial end of the second arm from a terminal end of the second arm;

a second lock post; wherein each of the telescoping tubes of the second arm comprises at least one hole; and wherein the second lock post is selectively positionable between an unlocked position wherein relative movement the telescoping tubes is enabled; and a locked position wherein the second lock post restricts relative movement of the telescoping tubes of the second arm;

a primary support pillar having a deck ground-engaging end and a seat-engaging end that engages a first seat, the primary support pillar engaging the first arm adjacent a terminal end of the first arm;

a secondary support pillar having a deck ground engaging end and a seat engaging end that engages a second seat, the secondary support pillar engaging the second arm adjacent a terminal end of the second arm; wherein the first arm and second arm are independently rotatable about the center post and at least one of the first arm and the second arm comprises a collar positioned adjacent its terminal end; and wherein the respective support pillar slidably engages within said collar.

2. The system as in claim 1, wherein the collar further comprises a first collar positioned adjacent the terminal end of the first arm; wherein, the primary support pillar slidably engages within the first collar.

3. The system as in claim 1, further comprising a central collar positioned adjacent the initial end of the first arm; wherein, the center post engages within the central collar.

4. The system as in claim 1, wherein the collar further comprises a second collar positioned adjacent the terminal end of the second arm; wherein, the secondary support pillar slidably engages within the second collar.

5. The system as in claim 1, further comprising a middle collar positioned adjacent the initial end of the second arm; wherein, the center post passes through the middle collar.

6. The system as in claim 1, wherein the first lock post includes a means for biasing the first lock post into the locked position.

7. The system as in claim 1, wherein the second lock post includes a means for biasing the second lock post into the locked position.

8. The system as in claim 1, further comprising a first seat mounted adjacent the seat-engaging end of the primary support pillar.

9. The system as in claim 1, further comprising a second seat mounted adjacent the seat engaging end of the secondary support pillar.

10. The system as in claim 1, further comprising:

aligned holes on each of the telescoping tubes of the first arm; and wherein the first lock post engages within respectively aligned holes when in the locked position.

11. The system as in claim 1, further comprising a base positioned at the ground engaging end of each of the primary and secondary support pillars.

12. The system as in claim 11, the base including at least one of a roller or a cushion for reducing friction when the secondary support pillar is moved relative the ground.

* * * * *